US012139283B2

(12) United States Patent
Schoen et al.

(10) Patent No.: US 12,139,283 B2
(45) Date of Patent: Nov. 12, 2024

(54) PACKAGING MACHINE FOR PACKAGING USING STRETCH WRAP

(71) Applicant: Bizerba SE & Co. KG, Balingen (DE)

(72) Inventors: Thomas Schoen, Balingen (DE); Kurt Wissmann, Geislingen (DE); Jonas Lauer, Albstadt (DE); Winai Namsuk, Gaertringen (DE); Konstantin Rempel, Quakenbrueck (DE)

(73) Assignee: BIZERBA SE & CO. KG, Balingen (DE)

( * ) Notice: Subject to any disclaimer, the term of this patent is extended or adjusted under 35 U.S.C. 154(b) by 111 days.

(21) Appl. No.: 18/081,768

(22) Filed: Dec. 15, 2022

(65) Prior Publication Data

US 2023/0202695 A1 Jun. 29, 2023

(30) Foreign Application Priority Data

Dec. 27, 2021 (EP) ..... 21217890.9

(51) Int. Cl.
*B65B 11/54* (2006.01)
*B65B 35/20* (2006.01)
*B65B 41/04* (2006.01)

(52) U.S. Cl.
CPC ..... *B65B 11/54* (2013.01); *B65B 35/205* (2013.01); *B65B 41/04* (2013.01)

(58) Field of Classification Search
CPC ..... B65B 57/14; B65B 11/54; B65B 35/205; B65B 41/04; B65B 59/001; B65B 35/56;
(Continued)

(56) References Cited

U.S. PATENT DOCUMENTS 4,074,506 A * 2/1978 Sander ..... B65B 57/10 53/493
4,522,013 A * 6/1985 Hamilton ..... B65B 11/54 53/220

(Continued)

FOREIGN PATENT DOCUMENTS

EP 0687558 A2 12/1995
EP 1728720 B1 10/2008

(Continued)

*Primary Examiner* — Gloria R Weeks
*Assistant Examiner* — Mobeen Ahmed
(74) *Attorney, Agent, or Firm* — LEYDIG, VOIT & MAYER, LTD.

(57) ABSTRACT

A method operates a packaging machine for wrapping a packaging film around packaging trays. The method includes: feeding the packaging film to a holding mechanism having two spaced-apart holders that hold the packaging film at two opposite sides; pressing a packaging tray against the packaging film by raising the packaging tray from below; and guiding opposite sides of the packaging film below the packaging tray. The packaging tray is raised by a raising device that raises a lifting platform from a transfer position into a packaging position, the lifting platform receives the packaging tray, and the packaging tray is transported from a loading position to the transfer position by a feed belt. The lifting platform is held in a middle position by the raising device while the feed belt is transporting the packaging tray between the loading position and the transfer position on an intermediate piece.

15 Claims, 4 Drawing Sheets

(58) Field of Classification Search
CPC ..... B65B 35/20; B65B 35/243; B65B 35/246; B65B 35/28
See application file for complete search history.

(56) References Cited

U.S. PATENT DOCUMENTS 4,543,766 A * 10/1985 Boshinski ..... G01G 19/40 53/64
4,631,903 A * 12/1986 Takamura ..... B65B 11/54 53/442
4,674,269 A * 6/1987 Denda ..... B65B 11/54 53/228
4,709,531 A * 12/1987 Denda ..... B65B 11/54 198/456
4,757,451 A * 7/1988 Denda ..... B65B 11/54 700/122
4,827,694 A * 5/1989 Owen ..... B65B 11/54 53/223
4,951,447 A * 8/1990 Denda ..... B65B 11/54 53/131.2
4,958,479 A * 9/1990 Treiber ..... B65B 11/54 53/223
5,144,787 A * 9/1992 Whitby ..... B65B 11/54 53/66
5,157,903 A * 10/1992 Nakashima ..... B65C 9/46 493/476
5,205,104 A * 4/1993 Nakashima ..... B65B 11/54 53/64
5,473,861 A * 12/1995 Fukunaga ..... B65B 11/54 53/228
5,528,881 A * 6/1996 Cappi ..... B65B 11/54 53/464
5,855,106 A * 1/1999 Koyama ..... B65B 41/12 53/64
5,927,469 A * 7/1999 Dunifon ..... B32B 17/10954 198/457.03
6,018,930 A * 2/2000 Rimondi ..... B65B 11/54 53/228
6,170,236 B1 * 1/2001 Whitby ..... B65B 35/24 53/556
6,666,005 B1 * 12/2003 Ohshita ..... B29C 65/749 53/329.3
6,895,728 B2 * 5/2005 Kondo ..... B65B 11/54 53/466
7,313,894 B2 * 1/2008 Mise ..... B65C 9/36 53/64
7,513,087 B2 * 4/2009 Kawanishi ..... B65B 57/14 53/329.4
10,035,613 B2 * 7/2018 Ono ..... B29C 65/7891
10,822,127 B2 * 11/2020 Tai ..... B65B 49/00
11,319,096 B2 * 5/2022 Gibson ..... B65B 41/14
11,649,118 B2 * 5/2023 Sleegers ..... B65B 35/44 198/781.06
2002/0062628 A1 * 5/2002 Whitby ..... B65B 57/14 53/493
2006/0272283 A1 * 12/2006 Kawanishi ..... B65B 11/54 53/76
2012/0090271 A1 * 4/2012 Rearick ..... B65B 25/06 53/562
2016/0214752 A1 * 7/2016 Ono ..... B29C 66/849
2016/0229574 A1 * 8/2016 Tanaka ..... B65B 61/26
2017/0190453 A1 * 7/2017 Heller ..... B65B 45/00
2018/0118395 A1 * 5/2018 Guzman ..... B65B 57/12
2019/0376833 A1 * 12/2019 Merz ..... B65G 47/28
2021/0122513 A1 * 4/2021 Rizzi ..... B65B 31/046

FOREIGN PATENT DOCUMENTS

EP 3187425 A1 7/2017
JP 06270907 A 9/1994

* cited by examiner

PACKAGING MACHINE FOR PACKAGING USING STRETCH WRAP

CROSS REFERENCE TO RELATED APPLICATIONS

This application claims benefit to European Patent Application No. EP 21217890.9, filed on Dec. 27, 2021, which is hereby incorporated by reference herein.

FIELD

The present disclosure relates to a method for operating a packaging machine for wrapping a packaging film, in particular a plastics stretch wrap film, around packaging trays for foodstuffs. The present disclosure further relates to a packaging machine for carrying out a method for operating a packaging machine.

BACKGROUND

Packaging trays in which food products are packaged, with the food product and the packaging tray wrapped in a stretch film, are known from supermarkets. In general, packaging trays for food products are also referred to, in short, as trays. In this case, a packaging machine comprising a feed device for feeding the packaging film, a holding mechanism for holding the fed packaging film at two opposite sides, and a feed belt by which the packaging trays containing the food products are fed to a raising device, in particular a lifting platform, is used for the packaging. The raising device then raises the fed packaging tray against the stretch film so that the stretch film is stretched over the packaging tray. The stretch film is preloaded in the process, i.e., the distance between the two holding means is increased after the stretch film has been fed and before the packaging tray containing the food product is raised against the stretch film. As a result, the stretch film can uniformly and cleanly contact the packaging tray containing the food product. Next, the packaging film is guided around the packaging tray by means of lateral folding pincers and a rear folding pincer and is folded underneath the bottom of the tray. When the tray leaves the raising device, the front film end is also folded underneath the bottom of the tray. Thereafter, the stretch film is bonded underneath the packaging tray, e.g., by means of a heat plate over which the packaging tray is guided. The packaging tray containing the foodstuff is then entirely enclosed by a taut stretch film.

By way of example, EP 1 728 720 B1 discloses a packaging machine of this kind. By way of example, EP 0 687 558 A2 discloses a stretch film that can be handled by a packaging machine of this kind.

To avoid malfunctions, the inventors have recognized that, it is important that the packaging trays are aligned in parallel with the transportation direction of the feed belt so that they then reach the lifting platform of the raising device aligned in parallel with the packaging film. If the packaging trays are twisted in the horizontal plane in relation to the packaging film on the lifting platform, malfunctions may occur during the packaging process, and the image on the packaging, and in particular the manner in which the folding pincers fold the packaging film underneath the packaging tray, is unsatisfactory. For this reason, in EP 1 728 720 B1 the packaging tray is oriented using a complex mechanism before it reaches the lifting platform.

SUMMARY

In an embodiment, the present disclosure provides a method that operates a packaging machine for wrapping a packaging film around packaging trays for foodstuffs. The method includes: feeding the packaging film to a holding mechanism having two spaced-apart holders in order to hold the packaging film at two opposite sides; pressing a packaging tray, of the packaging trays, against the fed packaging film by raising the packaging tray from below; and guiding opposite sides of the packaging film below the packaging tray. The packaging tray is raised by a raising device that raises a lifting platform from a transfer position into a packaging position, the lifting platform being configured to receive the packaging tray, and the packaging tray being transported from a loading position to the transfer position by a feed belt. The lifting platform is held in a middle position by the raising device while the feed belt is transporting the packaging tray between the loading position and the transfer position on an intermediate piece.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
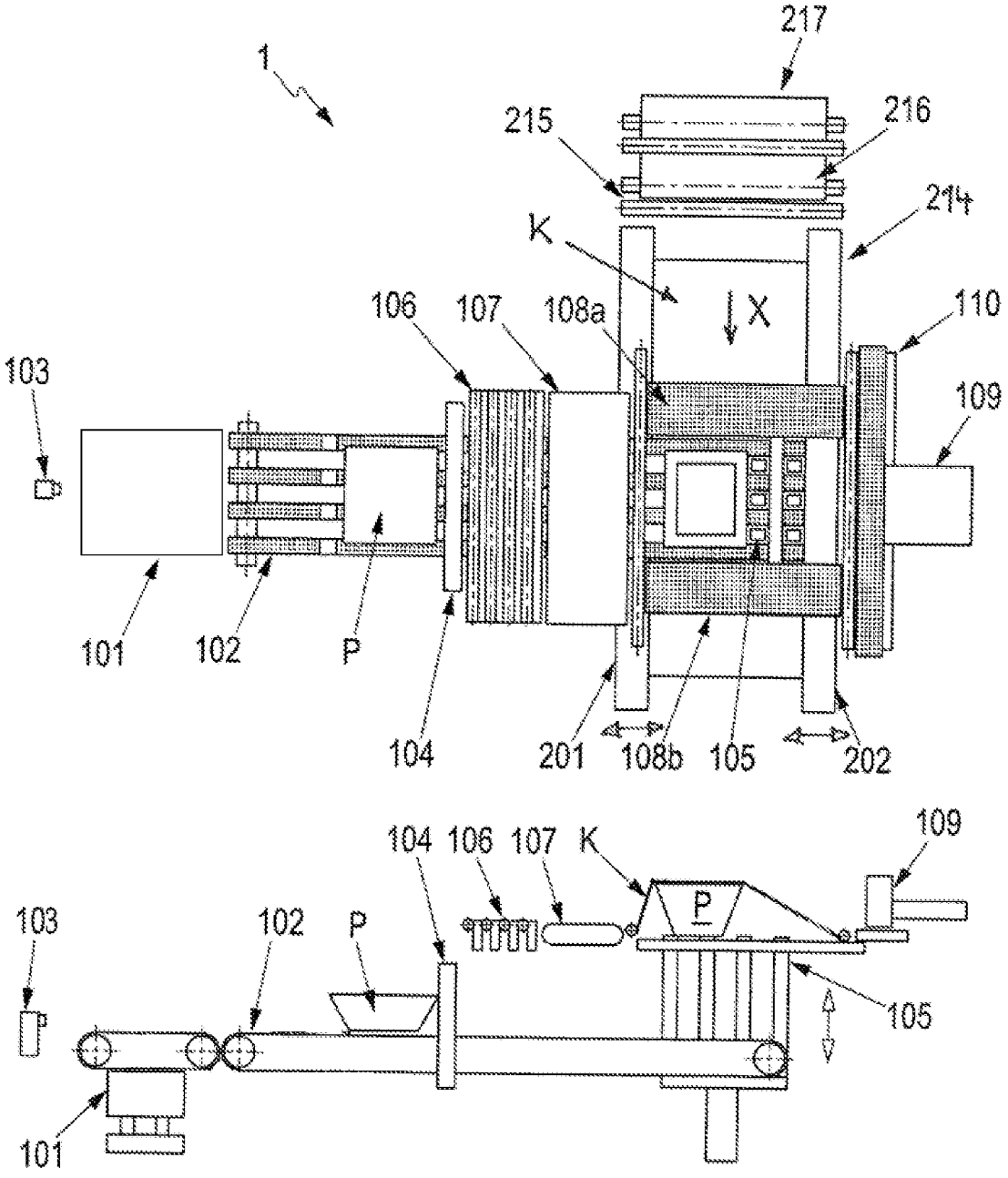
FIG. 1 is a schematic illustration of a packaging machine.

Aspects of the present disclosure provide a method and an apparatus that solve the problem of packaging misalignments in a simpler way than in the state of the art.

For example, the present disclosure provides a method for operating a packaging machine for wrapping a packaging film, in particular a plastics film, around packaging trays for foodstuffs, in which the packaging film is fed to a holding mechanism having two spaced-apart holding means in order to hold the fed packaging film at two opposite sides, and then a fed packaging tray is pressed against the fed packaging film by being raised from below, and then the opposite sides of the packaging film are guided below the packaging tray. The packaging tray may be raised by a raising device that raises a lifting platform from a transfer position into a packaging position, which lifting platform is configured to receive the packaging tray, and the packaging tray being transported from a loading position to the transfer position by means of a feed belt. The present disclosure further provides a packaging machine for carrying out such a method.

According to an aspect of the present disclosure, a method is provided for operating a packaging machine for wrapping packaging film around packaging trays for foodstuffs. The packaging film is fed to a holding mechanism having two spaced-apart holding means in order to hold the fed packaging film at two opposite sides. Next, a fed packaging tray is pressed against the fed packaging film by being raised from below. Next, the opposite sides of the packaging film are guided below the packaging tray. The packaging tray is raised by a raising device that raises a lifting platform from a transfer position into a packaging position, which lifting platform is configured to receive the packaging tray. The packaging tray is transported from a loading position to the transfer position by means of a feed belt. The lifting platform is held in a middle position by the raising device while the feed belt is transporting the packaging tray between the loading position and the transfer position on an intermediate piece.

In one embodiment, the lifting platform comprises orientation fingers below the bearing surface of the lifting platform. The orientation fingers are located in the conveying path of the feed belt, in particular in the conveying path of the intermediate piece of the feed belt, when the lifting platform is arranged in the middle position. The orientation fingers are not located in the conveying path of the feed belt when the lifting platform is in the transfer position.

In one embodiment, during transportation from the loading position to the transfer position, the packaging tray is pressed against the orientation fingers by the feed belt when the lifting platform is in the middle position.

In one embodiment, the orientation fingers for the packaging tray form a straight stop that runs orthogonally to the transportation direction of the belt conveyor, and the packaging tray is pressed against the orientation fingers by the transportation movement of the feed belt.

In one embodiment, the feed belt has a coefficient of friction that is such that the packaging tray is transported in the transportation direction on the feed belt when the feed belt is moving in the conveyance direction and the packaging tray slides on the feed belt when the packaging tray hits the orientation fingers while the feed belt is moving in the transportation direction.

In one embodiment, the lifting platform is lowered from the middle position into the transfer position by the raising device once the packaging tray has hit the orientation fingers.

In one embodiment, the raising device lowers the lifting platform from the middle position into the transfer position in less time than it takes the feed belt to transport the packaging tray from an upper edge of the orientation fingers to a front edge of the lifting platform.

In one embodiment, the time at which the packaging tray hit the orientation fingers is determined by the ending of a timer that is started when the packaging tray is transferred from a weighing belt to the feed belt. In one embodiment, the time at which the packaging tray hit the orientation fingers is determined by a sensor close to the orientation fingers or on the orientation fingers.

In one embodiment, the lifting platform is raised from the transfer position into the packaging position by the raising device once the packaging tray has been moved onto the lifting platform into the transfer position by the feed belt.

According to an aspect of the present disclosure, a packaging machine is provided for wrapping packaging film around packaging trays for foodstuffs. The packaging machine is suitable in particular for carrying out the methods according to the present disclosure. The packaging machine comprises a feed device for feeding the packaging film, a holding mechanism having two spaced-apart holding means in order to hold the fed packaging film at two opposite sides, the distance between the two holding means being adjustable, and a feed belt for feeding the packaging trays from a loading position to a transfer position. The packaging machine comprises a raising device in order to move the fed packaging tray from the transfer position into a packaging position on a lifting platform by raising it from below and to press it against the fed packaging film. The packaging machine comprises an operating mode in which the lifting platform is held in a middle position by the raising device while the feed belt transports the packaging tray between the loading position and the transfer position on an intermediate piece.

In one embodiment, the lifting platform comprises orientation fingers below the bearing surface of the lifting platform. The orientation fingers are located in the conveying path of the feed belt, in particular in the conveying path of the intermediate piece of the feed belt, when the lifting platform is arranged in the middle position. The orientation fingers are not located in the conveying path of the feed belt when the lifting platform is in the transfer position.

In one embodiment, the lifting platform consists of a base plate on which a plurality of rod-like mounts are attached. Heads, in particular tilting heads, are attached to the tops of the mounts. The heads form a bearing surface of the lifting platform for the packaging tray. L-shaped, downward-facing orientation fingers are attached to the base plate and form a stop in the transportation path of the feed belt when the lifting platform is in the middle position.

In one embodiment, the feed belt is formed as a belt composed of a plurality of drive belts running in parallel in the transportation direction, each drive belt being guided around a deflection roll located downstream in the transportation direction, and the downstream deflection rolls in particular overlapping the footprint of the lifting platform in the horizontal plane.

In one embodiment, the stop fingers are arranged between the drive belts when the lifting platform is in the middle position.

In one embodiment, the base plate comprises cut-outs so that the base plate can be moved through the conveyance plane formed by the drive belts. In particular, the drive belts of the feed belt move through the cut-outs when the base plate moves vertically.

FIG. 1 is a schematic illustration of a packaging machine 1. The top part of the figure is a schematic plan view of the packaging machine 1 and the bottom part of the figure is a side view thereof.

The packaging machine 1 comprises a film dispensing device 217, a film feed device 216, a film transportation device 214, and a film cutting device 215 arranged between the film feed device 216 and the film transportation device 214. A roll of a packaging film K, in particular a plastics film, can be inserted into the film dispensing device 217, where it can be retained by a film holder or roll holder. By means of the film feed device 216, an unwound end of the packaging film K can then be transferred to the film transportation device 214.

The film transportation device 214 has two drive belt conveyor devices 201 and 202, which are arranged in parallel at a spacing from one another, for conveying the fed packaging film K in a transportation direction X at two opposite sides until the front edge of the packaging film K arrives at the front end (when viewed in the transportation direction X) of the film transportation device 214, at which point the transportation of the film is stopped and the packaging film K is severed from the rest of the film roll by means of the film cutting device 215. In addition, the drive belt conveyor devices 201 and 202 are configured to clampingly hold the in particular severed packaging film K at the two opposite sides. For this purpose, lifting actuators, as fundamentally known from the state of the art, may be provided, for example.

The film transportation device 214 is configured such that the distance between the two drive belt conveyor devices 201 and 202 is adjustable. To adjust the distance between them, the first drive belt conveyor device 201 or the second drive belt conveyor device 202, or both drive belt conveyor devices 201 and 202 simultaneously, can be moved transversely to the film transportation direction X, in particular by means of a motor drive controlled by a control unit of the packaging machine 1.

In addition, the packaging machine 1 has a feed belt 102 by means of which packaging trays P, containing food products therein, that are to be wrapped in the packaging film K can be fed to a lifting platform 105 of the packaging machine 1. The feed belt 102 consists of a plurality of drive belts that are arranged in parallel and engage in the lifting platform. The lifting platform 105 is configured to transport each packaging tray P upward toward the packaging film K held in the film transportation device 214, in such a way that the packaging tray P is pressed against the packaging film K from below such that the packaging film K is automatically placed around the packaging tray P during the lifting operation. This upper position of the lifting platform 105 is the packaging position. The lower position of the lifting platform 105, in which the packaging tray P is conveyed onto the lifting platform 105 by means of the feed belt 102, is the transfer position.

Upstream of the feed belt 102 there is a weighing belt 101 having integrated scales, by which the weight of the packaging tray P and food product can be determined. This is fundamentally optional in packaging machines 1 and is used for packaging machines 1 that are suitable for affixing, to a packaging tray P, a label indicating the weight of the packaging tray P together with the food product therein. A printer connected to the scales 101 can then print a label that states the weight of the filled packaging tray P. The labeling apparatus takes the label from the printer and applies it to the packaged packaging tray P.

An operator places the packaging tray P on the weighing belt 101 or, in the case of a packaging machine 1 without a weighing belt 101, on the front part of the feed belt 102. This is the loading position of the packaging machine. A camera 103, using which various tray types can be detected, is provided in the intake region of the packaging machine, i.e., in the intake region of the feed belt 102 or on the weighing belt 101. The packaging process is adjusted by the control unit depending on the detected packaging tray P. Moreover, a photoelectric sensor 104 may additionally be used to ascertain when a packaging tray is moved by the feed belt 102 against orientation fingers located on the lifting platform 105. The lifting platform is described below with reference to FIGS. 2, 3*a*, and 3*b*.

To wrap the packaging trays P further, once the packaging tray P has been raised the packaging film K is guided downward around the packaging tray P to the side and at the rear by means of lateral folding pincers 108*a* and 108*b* and by means of a rear folding pincer 110 and is folded underneath the packaging tray P or the bottom of the packaging tray P. Next, the packaging tray P is pushed out of the film packaging region onto a sealing plate 107 by a pusher 109, as a result of which the front end of the packaging film K is folded underneath the packaging tray P. The sealing plate 107 is heated to a temperature at which the ends of the packaging film K that have been folded underneath the packaging tray P are bonded or sealed together.

Lastly, using a labeling apparatus, a label that includes, inter alia, the weight determined by the scales 101 can be affixed to the packaged packaging tray P, which can then be transported out of the packaging machine by means of a cross-conveyor 106.

A stretchable plastics film, i.e., a "stretch film," can be used as the packaging film. This packaging film is thermoplastic and can be sealed or bonded at a high temperature. The thickness of the packaging film is usually in a range between 10 μm and 60 μm.

Figure 2:
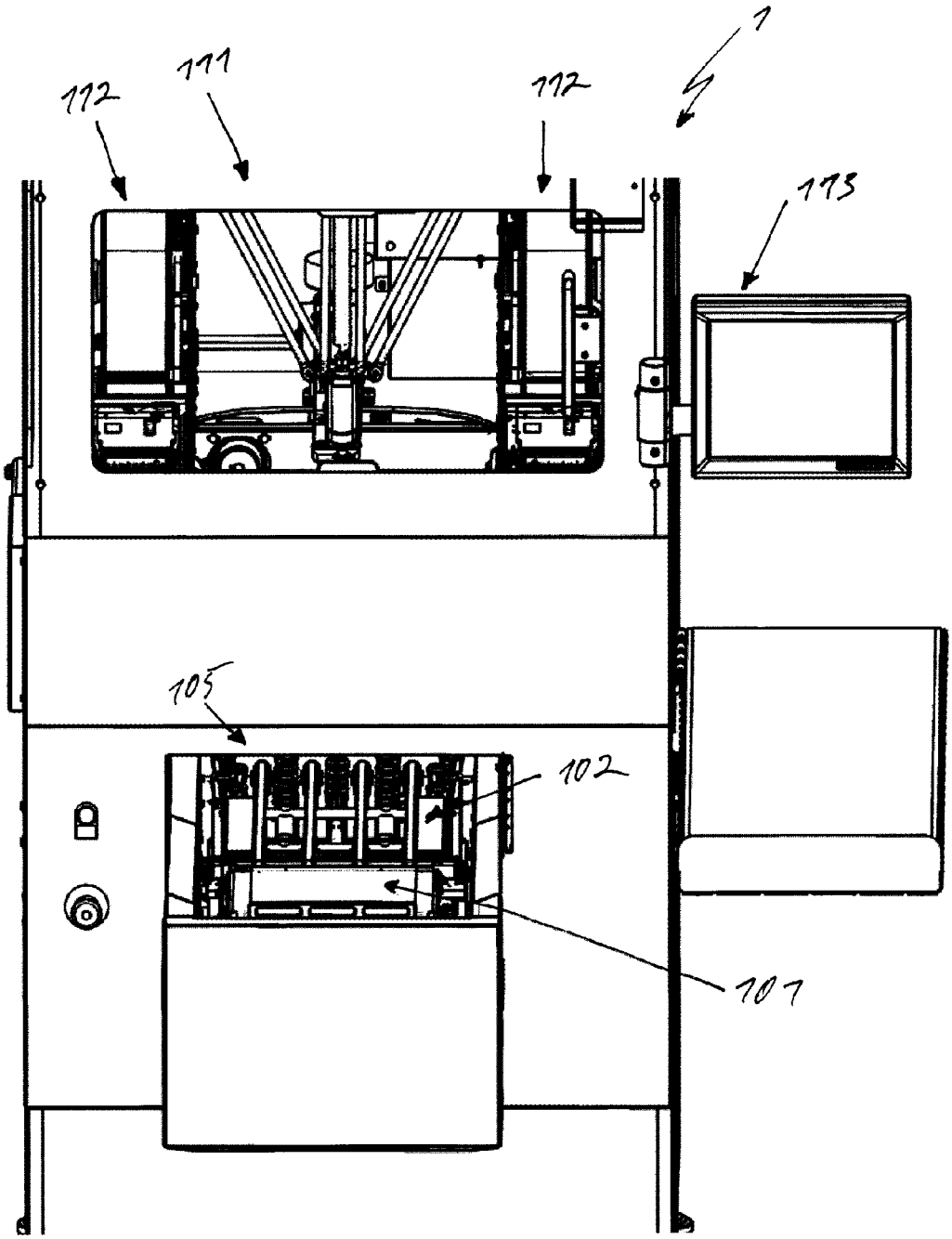
FIG. 2 shows a detail of the packaging machine together with the feed belt and lifting platform.

FIG. 2 is a front view of a packaging machine 1. In this case, a front opening forms an infeed channel, at the entrance of which the weighing belt 101 is located. The feed belt 102 is arranged downstream of the weighing belt 101. The feed belt 102 is configured as a drive belt conveyor having four drive belts running in parallel. The drive belts of the feed belt form a horizontal plane on which the packaging tray P rests by its underside. The feed belt 102, i.e., the drive belts of the feed belt 102, leads to a lifting platform 105. The lifting platform 105 is shown in more detail in FIGS. 3*a* and 3*b* and consists of a plurality of rod-like mounts, to the tops of which tilting heads are attached. In this case, the heads form a bearing surface for the packaging tray. When the lifting platform 105 is in the transfer position, the drive belts of the feed belt lead into the gaps between the rod-like mounts. In this case, the horizontal plane formed by the drive belts of the feed belt is arranged slightly above the horizontal plane formed by the heads. The effect of this is that a packaging tray P can be transported onto the lifting platform 105 on the drive belts of the feed belt. When the lifting platform 105 is raised, the packaging tray P is thus pushed upward by the heads and is removed from the feed belt 102.

Figure 3A:
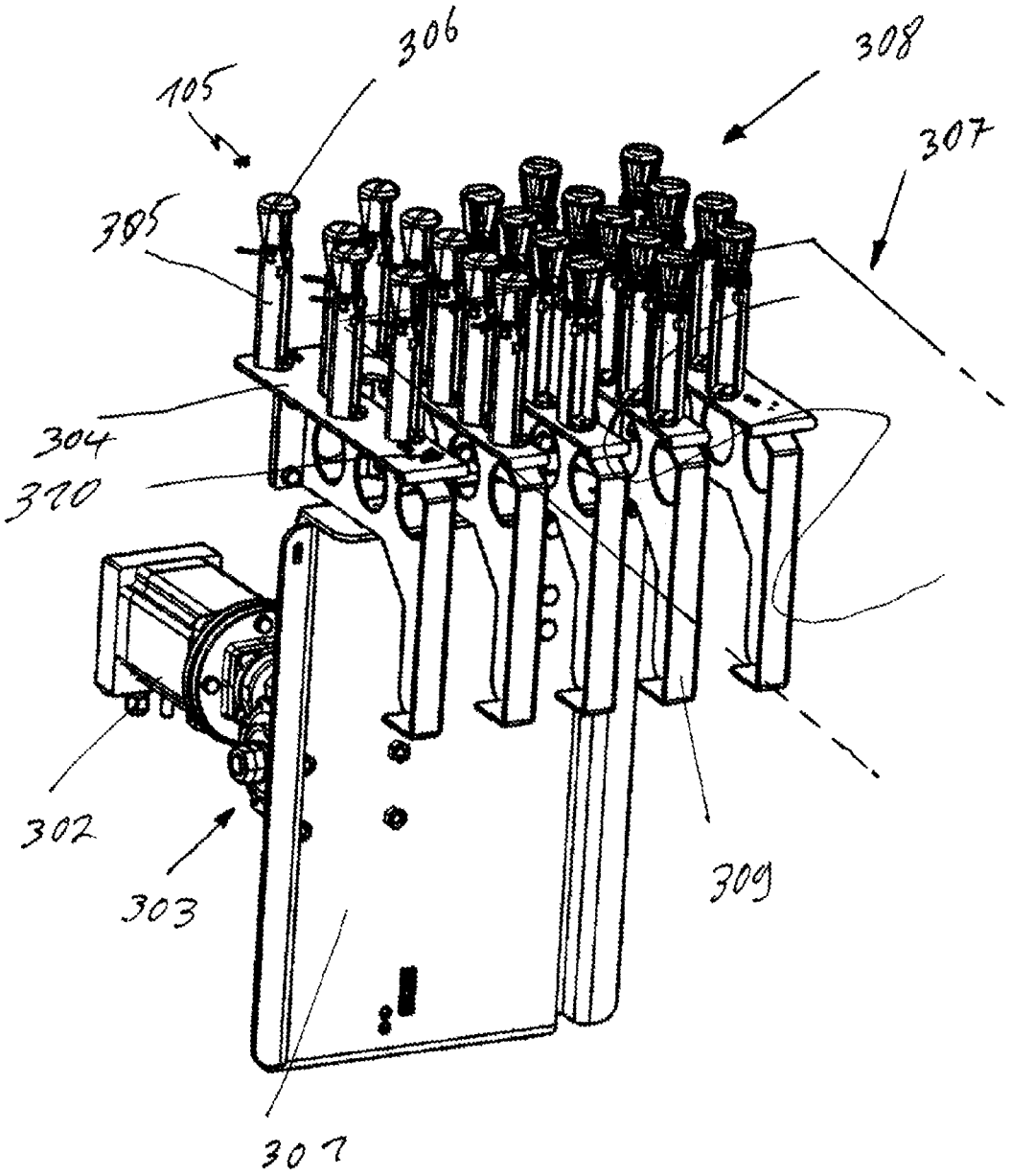
FIGS. 3*a* and 3*b* show the lifting platform in a transfer position and in a middle position.
Figure 3B:
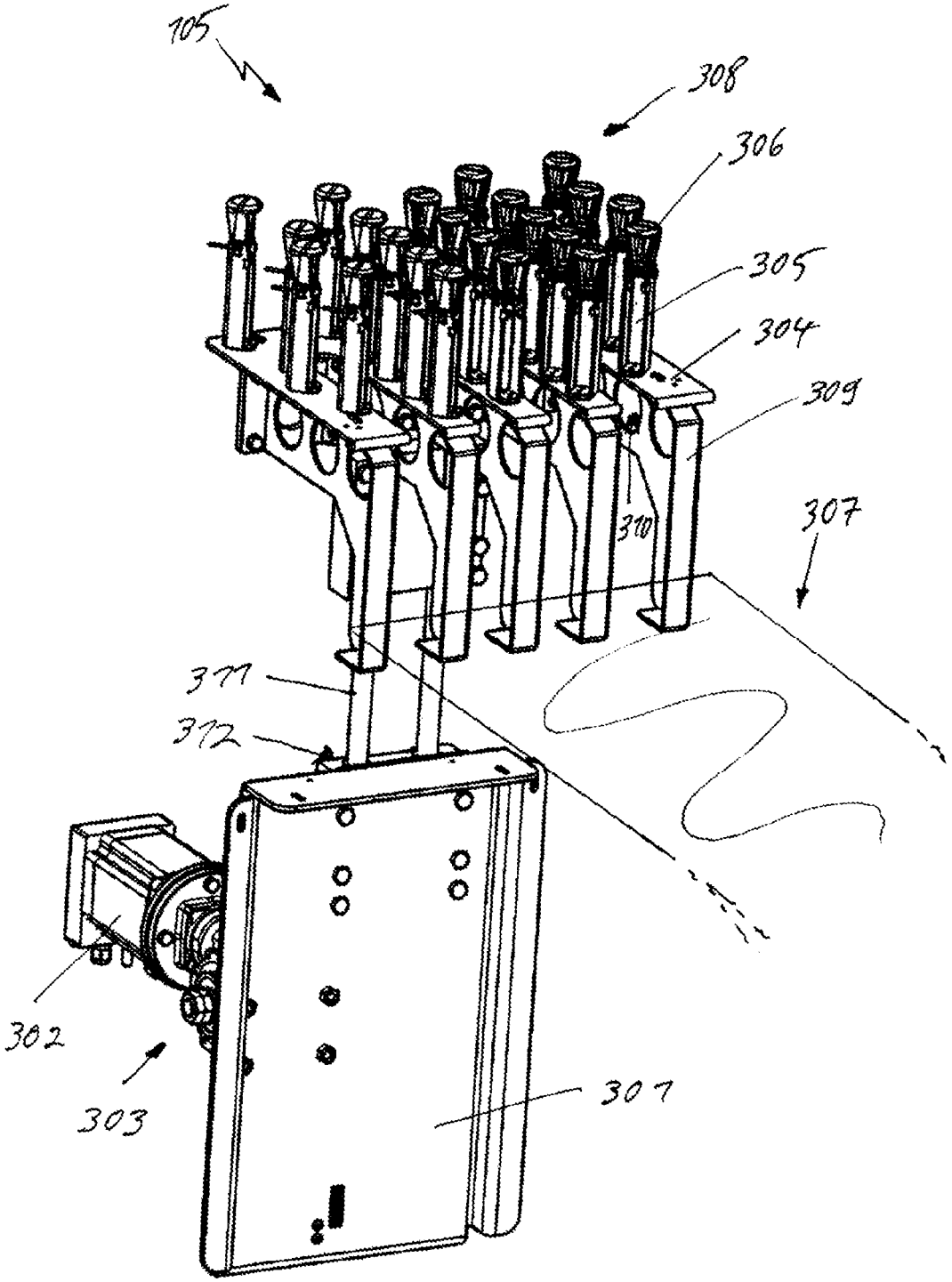

FIG. 3*a* shows the lifting platform 105 of the packaging machine 1 in the transfer position, i.e., in the lower position. FIG. 3*b* shows the lifting platform 105 of the packaging machine 1 in the middle position, i.e., in the position in which the packaging tray P is pressed against the orientation fingers by the feed belt 102 when the packaging tray on the feed belt is moved between the loading position and the transfer position on an intermediate piece. In this context, the middle position and packaging position are only slightly different. It merely needs to be ensured that, in the middle position, the top edge of the heads does not touch the packaging film K already located in the holding means.

The lifting platform 105, i.e., the raising device, consists of a support 301, which is connected to a frame of the packaging machine 1. It comprises a motor 302 to which a raising mechanism 303 is connected. Using a plain bearing 312, the raising mechanism displaces bars 311, which are fastened to the support 301, in the vertical direction. A base plate 304 of the lifting platform 105 is located on the bars 311. The base plate comprises four cut-outs 310 that are open to the front and in which the drive belts of the feed belt 102 can engage. On the base plate 304 there are fastened a plurality of rod-like mounts 305, which project upward from the base plate 304 in the vertical direction. Tilting heads 306 are arranged on the top end of the rod-like mounts 305. The tilting heads 306 form a horizontal plane 308 on which the packaging tray is positioned when it is moved upward in the vertical direction by the raising mechanism. The heads 306 can tilt, and they tilt over when they come into contact with the folding pincers so as not to impede the movement of the folding pincers. L-shaped, downward-pointing orientation fingers 309 are attached to the base plate. The orientation fingers 309 form a stop in the transportation direction, which stop is oriented orthogonally to the transportation direction.

The drive belts of the feed belt 102 form a horizontal plane 307 (schematically indicated) that is slightly higher in the vertical direction than the plane 308 formed by the heads 306 when the lifting platform 105 is in the transfer position (FIG. 3*a*). When the lifting platform 105 is in the middle position, the drive belts of the feed belt 102 form a horizontal plane 307 (schematically indicated) through which the orientation fingers 309 project in the vertical direction (FIG. 3*b*). The orientation fingers thus form a stop oriented orthogonally to the transportation direction of the feed belt. A packaging tray being transported on the feed belt 102 in the transportation direction thus hits the vertical plane formed by the stop fingers 309. Since the stop fingers form a plane orthogonal to the plane 307 of the feed belt 102, the orientation fingers 309 orient the packaging tray perpendicularly to the transportation direction.

The functions of various elements shown in the drawings, including the functional blocks, may be implemented by dedicated hardware or by generic hardware capable of executing software, in conjunction with the corresponding software. If the functions are provided by means of a processor, they may be provided by a single dedicated processor, a single shared processor, or a plurality of generic processors which may in turn be shared. The functions may be provided, without limitation, by a digital signal processor (DSP), network processor, application-specific integrated circuit (ASIC), field programmable gate array (FPGA), read-only memory (ROM) with stored software, random access memory (RAM), and non-volatile memories.

While subject matter of the present disclosure has been illustrated and described in detail in the drawings and foregoing description, such illustration and description are to be considered illustrative or exemplary and not restrictive. Any statement made herein characterizing the invention is also to be considered illustrative or exemplary and not restrictive as the invention is defined by the claims. It will be understood that changes and modifications may be made, by those of ordinary skill in the art, within the scope of the following claims, which may include any combination of features from different embodiments described above.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A method for operating a packaging machine for wrapping a packaging film around packaging trays for foodstuffs, the method comprising:

feeding the packaging film to a holding mechanism having two spaced-apart holders in order to hold the packaging film at two opposite sides;

pressing a packaging tray, of the packaging trays, against the fed packaging film by raising the packaging tray from below; and guiding opposite sides of the packaging film below the packaging tray, wherein the packaging tray is raised by a raising device that raises a lifting platform from a transfer position into a packaging position, the lifting platform being configured to receive the packaging tray, and the packaging tray being transported from a loading position to the transfer position by a feed belt, wherein the lifting platform is held in a middle position by the raising device while the feed belt is transporting the packaging tray between the loading position and the transfer position on an intermediate piece, wherein the lifting platform comprises orientation fingers below a bearing surface of the lifting platform, the orientation fingers being located in a conveying path of the feed belt, when the lifting platform is arranged in the middle position, and the orientation fingers not being located in the conveying path of the feed belt when the lifting platform is in the transfer position, and wherein, during transportation from the loading position to the transfer position, the packaging tray is pressed against the orientation fingers by the feed belt when the lifting platform is in the middle position.

2. The method for operating the packaging machine according to claim 1, wherein the orientation fingers for the packaging tray form a straight stop that runs orthogonally to the transportation direction of the belt conveyor, and wherein the packaging tray is pressed against the orientation fingers by the transportation movement of the feed belt.

3. The method for operating the packaging machine according to claim 1, wherein the feed belt has a coefficient of friction that is configured such that the packaging tray is transported in the transportation direction on the feed belt when the feed belt is moving in the conveyance direction and the packaging tray slides on the feed belt when the packaging tray hits the orientation fingers while the feed belt is moving in the transportation direction.

4. The method for operating the packaging machine according to claim 1, wherein the lifting platform is lowered from the middle position into the transfer position by the raising device once the packaging tray has hit the orientation fingers.

5. The method for operating the packaging machine according to claim 4, wherein the raising device lowers the lifting platform from the middle position into the transfer position in less time than it takes the feed belt to transport the packaging tray from an upper edge of the orientation fingers to a front edge of the lifting platform.

6. The method for operating the packaging machine according to claim 4, wherein the time at which the packaging tray hit the orientation fingers is determined by the ending of a timer that is started when the packaging tray is transferred from a weighing belt to the feed belt, or is determined by a sensor close to the orientation fingers or on the orientation fingers.

7. The method for operating the packaging machine according to claim 1, wherein the lifting platform is raised from the transfer position into the packaging position by the raising device once the packaging tray has been moved onto the lifting platform into the transfer position by the feed belt.

8. The method for operating the packaging machine according to claim 1, wherein the orientation fingers are located in the conveying path of the intermediate piece of the feed belt.

9. A packaging machine for wrapping a packaging film around packaging trays for foodstuffs, the packaging machine comprising:

a feed device configured to feed the packaging film;

a holding mechanism comprising two spaced-apart holders configured to hold the fed packaging film at two opposite sides, the distance between the two holders being adjustable;

a feed belt configured to feed the packaging trays from a loading position to a transfer position; and a raising device configured to move a fed packaging tray, of the packaging trays, on a lifting platform by raising the fed packaging tray from below from the transfer position into a packaging position and configured to press the fed packaging tray against the fed packaging film, wherein the packaging machine is configured to execute an operating mode in which the lifting platform is held in a middle position by the raising device while the feed belt is transporting the packaging tray between the loading position and the transfer position on an intermediate piece, and wherein the lifting platform consists of a base plate, on which there are attached a plurality of rod-like mounts, to the tops of which tilting heads, are attached, the tilting heads forming a bearing surface of the lifting platform for the packaging tray, and L-shaped, downward-facing orientation fingers being attached to the base plate and forming a stop in the transportation path of the feed belt when the lifting platform is in the middle position.

10. The packaging machine for wrapping the packaging trays according to claim 9, wherein the lifting platform comprises orientation fingers below the bearing surface of the lifting platform, the orientation fingers being located in the conveying path of the feed belt, and the orientation fingers not being located in the conveying path of the feed belt when the lifting platform is in the transfer position.

11. The packaging machine for wrapping the packaging trays according to claim 9, wherein the feed belt is formed as a belt comprising a plurality of drive belts running in parallel in the transportation direction, each of the drive belts being guided around a deflection roll located downstream in the transportation direction, the downstream deflection roll overlapping the footprint of the lifting platform in the horizontal plane.

12. The packaging machine for wrapping the packaging trays according to claim 11, wherein the L-shaped, downward-facing orientation fingers are configured to be between the drive belts when the lifting platform is in the middle position.

13. The packaging machine for wrapping the packaging trays according to claim 11, wherein the base plate comprises cut-outs so that the base plate is moveable through the conveyance plane formed by the drive belts.

14. The packaging machine according to claim 9 configured to perform the method of claim 1.

15. A method for operating a packaging machine for wrapping a packaging film around packaging trays for foodstuffs, the method comprising:

feeding the packaging film to a holding mechanism having two spaced-apart holders in order to hold the packaging film at two opposite sides;

pressing a packaging tray, of the packaging trays, against the fed packaging film by raising the packaging tray from below; and guiding opposite sides of the packaging film below the packaging tray, wherein the packaging tray is raised by a raising device that raises a lifting platform from a transfer position into a packaging position, the lifting platform being configured to receive the packaging tray, and the packaging tray being transported from a loading position to the transfer position by a feed belt, wherein the lifting platform is held in a middle position by the raising device while the feed belt is transporting the packaging tray between the loading position and the transfer position on an intermediate piece, wherein the lifting platform comprises orientation fingers below a bearing surface of the lifting platform, the orientation fingers being located in a conveying path of the feed belt, when the lifting platform is arranged in the middle position, and the orientation fingers not being located in the conveying path of the feed belt when the lifting platform is in the transfer position, wherein the orientation fingers for the packaging tray form a straight stop that runs orthogonally to the transportation direction of the belt conveyor, and wherein the packaging tray is pressed against the orientation fingers by the transportation movement of the feed belt.

* * * * *